US007082657B1

(12) United States Patent
Lin

(10) Patent No.: US 7,082,657 B1
(45) Date of Patent: Aug. 1, 2006

(54) AUTOMATIC SUCTION AND REPELLING DEVICE FOR RIVET GUN

(76) Inventor: Yu-Ching Lin, P. O. Box 96-405, His-CTaipei 106 (TW)

( * ) Notice: Subject to any disclaimer, the term of this patent is extended or adjusted under 35 U.S.C. 154(b) by 0 days.

(21) Appl. No.: 11/059,401

(22) Filed: Feb. 17, 2005

(51) Int. Cl.
*B21J 15/34* (2006.01)
*B21J 15/22* (2006.01)

(52) U.S. Cl. ..... 29/243.525; 29/243.523; 29/243.524

(58) Field of Classification Search ..... 72/391.4; 29/243.521, 243.523, 243.524, 243.525
See application file for complete search history.

(56) References Cited

U.S. PATENT DOCUMENTS 4,454,746 A * 6/1984 Schwab ..... 29/243.525
4,515,005 A * 5/1985 Klein ..... 29/243.525
4,704,888 A * 11/1987 Frearson ..... 72/391.4
4,887,450 A * 12/1989 Gast et al. ..... 72/391.4
5,351,379 A * 10/1994 Chu ..... 29/243.525
5,490,311 A * 2/1996 Rosier ..... 29/243.523
5,697,137 A * 12/1997 Frearson et al. ..... 29/243.525
6,367,139 B1 * 4/2002 Wille ..... 29/243.525

* cited by examiner

*Primary Examiner*—David Jones
(74) *Attorney, Agent, or Firm*—Troxell Law Office, PLLC

(57) ABSTRACT

An automatic suction and repelling device for rivet gun, which comprises a body and a handle, and the intake passages thereof are in communication each other; the rear center of the body is furnished with a regulation ring and a used-nail cylinder; the regulation ring can be adjusted to move by means of screwing so as to adjust the volume of pressure air to enter the body, and to adjust the vacuum suction force in the used-nail pipe; during rivet-pulling work, the rivet gun can automatically suck in, and can suck a used nail into the used-nail cylinder upon the rivet-pulling work done.

2 Claims, 5 Drawing Sheets

AUTOMATIC SUCTION AND REPELLING DEVICE FOR RIVET GUN

BACKGROUND OF THE INVENTION

1. Field of the Invention

This invention relates to a rivet gun, and particularly to an automatic suction and repelling device for a rivet gun.

2. Description of the Prior Art

In a conventional rivet gun, a pressure-air tank is furnished under the handle. When pressured air enters the pressure-air tank, it can drive a piston to move. The pressured air is then changed into a hydraulic pressure so as to enable a pulling device to pull a pull rod assembly on the front end thereof, and to provide a rivet-pulling force.

According to the aforesaid rivet gun, the pull rod of a rivet has to be plugged into a round hole on front end of the pull rod assembly, and then the rivet is plugged into a rivet hole before a rivet-pulling work being started; finally pull the trigger to start the rivet-pulling work; however, the conventional rivet gun is not furnished with a nail-sucking device between the pull rod hole and the round hole of the pull rod assembly; as a result, a rivet can not be plugged in the round hole correctly or in a sloping position before the rivet-pulling working being done.

In a conventional rivet gun, the rear end of the body is furnished with an intake connector, of which the outer end is connected with a control valve through a pipe or tube; the inside of the connector is connected with a guide passage of a nail-repelling pipe; the guide passage is normally filled with a pressure air so as to provide a vacuum suction force for sucking a rivet in place properly, and for repelling a used nail automatically during a rivet-pulling work.

The aforesaid rivet gun has a nail-sucking function all right, but it must have an outer tube to connect with an outer control valve, and it can not work synchronously with the pull rod assembly.

SUMMARY OF THE INVENTION

The primary objective of the present invention is to provide an automatic suction and repelling device for a rivet gun, in which a front end of a body is furnished with a pull rod assembly, while the front end thereof is furnished with a used-nail cylinder. A support frame is fixedly mounted under the body. The support frame has an intake passage in communication with a valve in the trigger. The intake passage is in communication with an inner cylindrical hole of the body via small hole. A volume of pressurized air entering the small hole can be adjusted by screwing a regulation ring to move. The pressurized air can flow into the passage and an extension pipe to provide a vacuum suction force for sucking a nail or repelling a used nail.

Another object of the present invention is to provide an automatic suction and repelling device for rivet gun, in which the outer end of an inner cylindrical hole of the body is mounted with a regulation ring; one end of the inner cylindrical hole of the regulation ring is mounted with a spring which is set against a positioning surface to provide the hydraulic pull rod with a return force.

Still another object of the present invention is to provide an automatic suction and repelling device for rivet gun, in which the outer end of an inner cylindrical hole of the body is mounted with a regulation ring; the inner end of the regulation ring is furnished with a cylinder portion mounted with a limit ring and an O-shaped ring and groove; the limit ring is used for mounting a limit screw to limit the moving space of the regulation ring; the moving space of the O-shaped ring is used for regulating the volume of a pressure air flowed into the intake passage so as to adjust the vacuum suction force in the convergent hole.

A further object of the present invention is to provide an automatic suction and repelling device for rivet gun, in which the outer end of an inner cylindrical hole of the body is mounted with a regulation ring; the inside of the positioning ring of the spring is furnished with a guide sleeve, of which the inner surface is in contact with the outer surface of the outer sleeve pipe; the inner side of the guide sleeve is furnished with a groove for maintaining a through passage upon the guide sleeve moving together with the regulation ring simultaneously so as to adjust the vacuum suction force in the convergent hole of the outer sleeve pipe.

DETAILED DESCRIPTION OF THE PREFERRED EMBODIMENT

Figure 1:
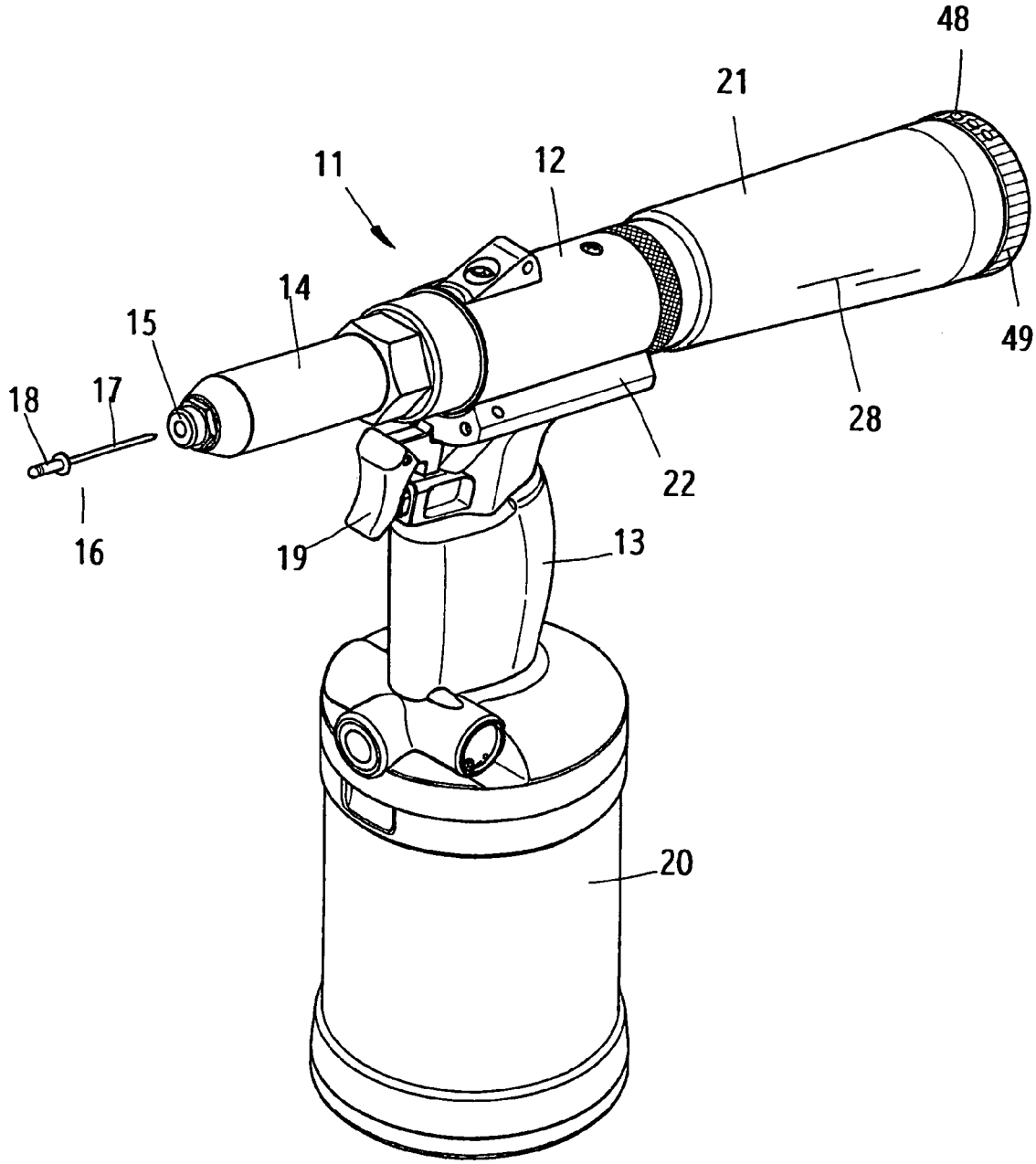
FIG. 1 is a perspective view of a rivet gun according to the present invention.
Figure 2:
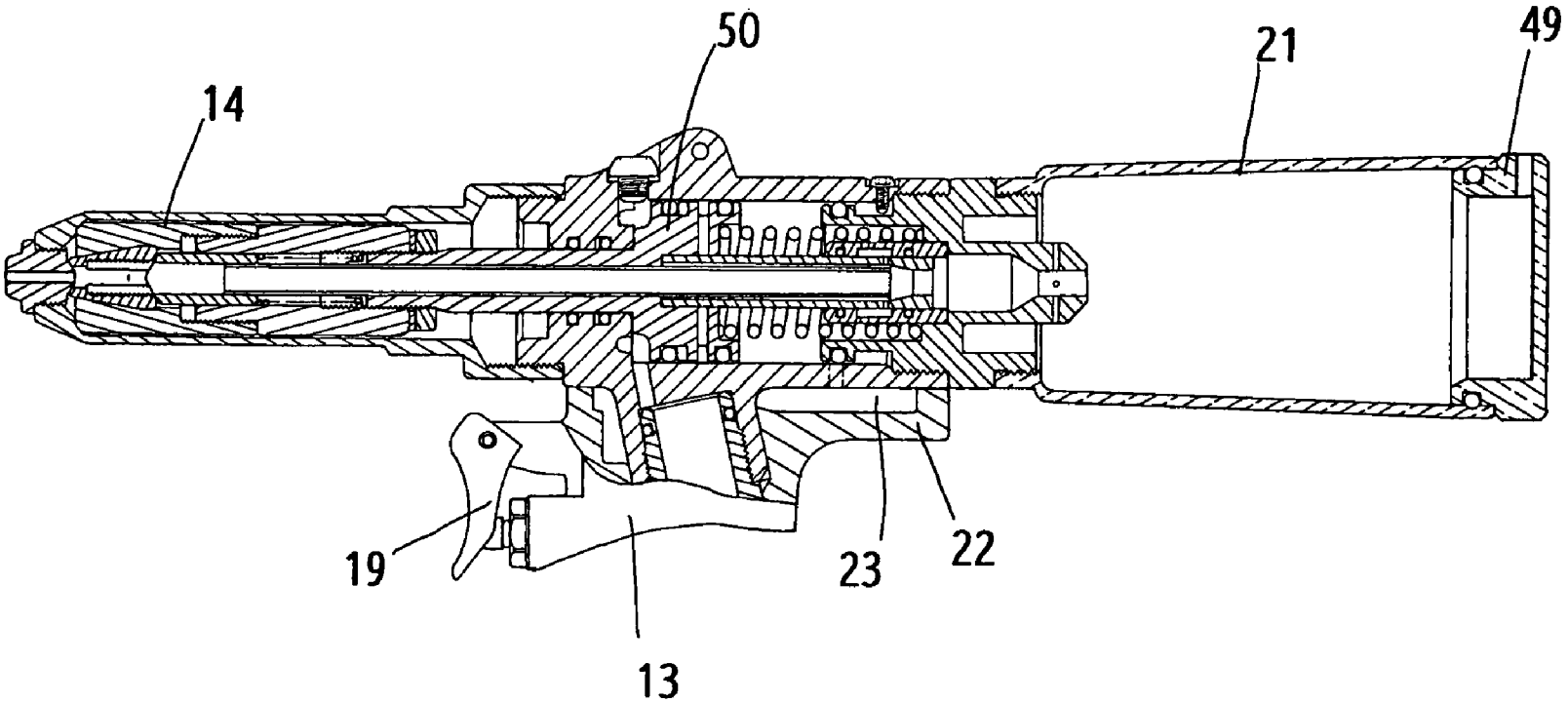
FIG. 2 is a sectional view of the present invention, showing the inner structure thereof.
Figure 3:
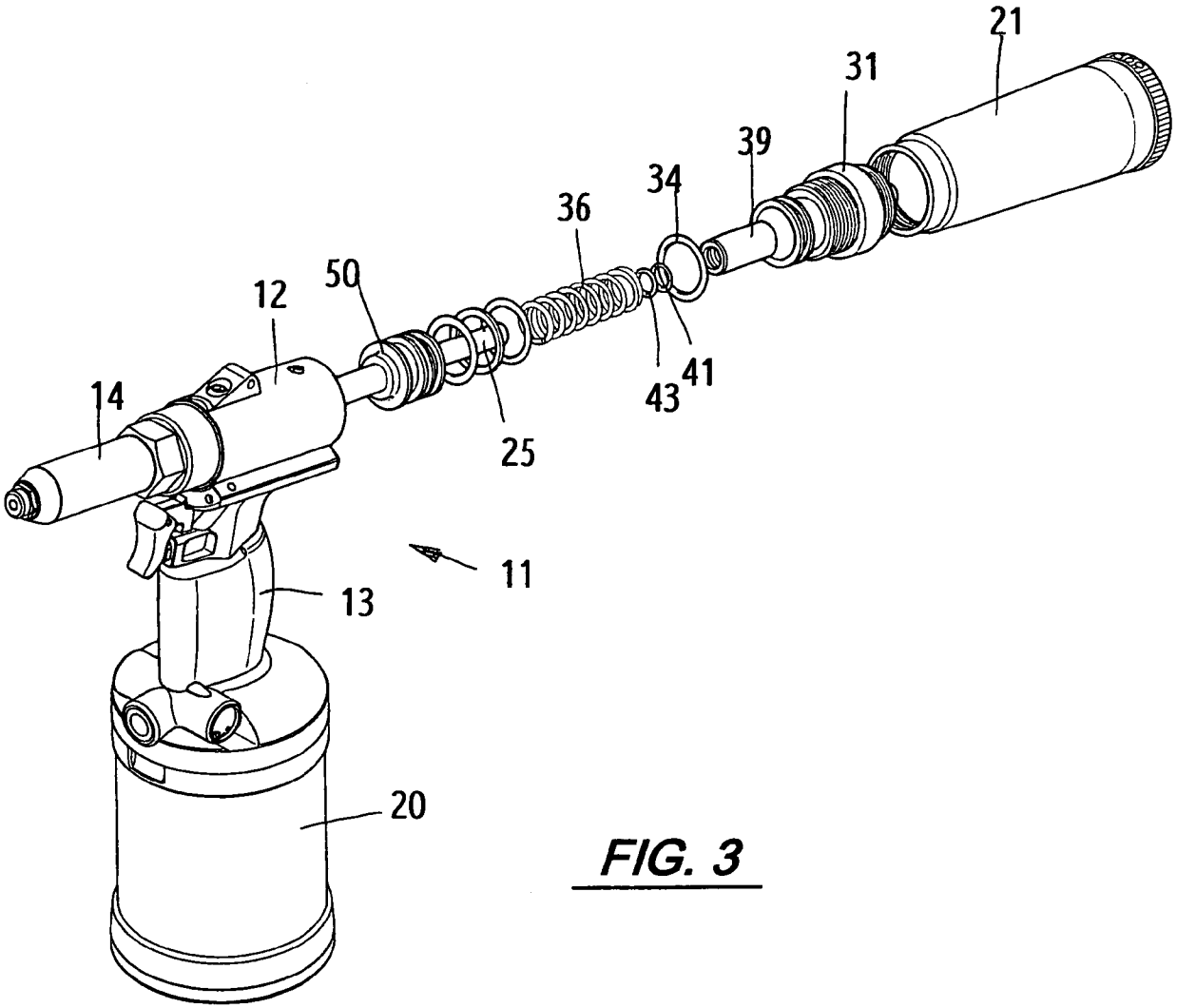
FIG. 3 is a disassembled view of the present invention, showing the rear structure of the rivet gun.
Figure 4:
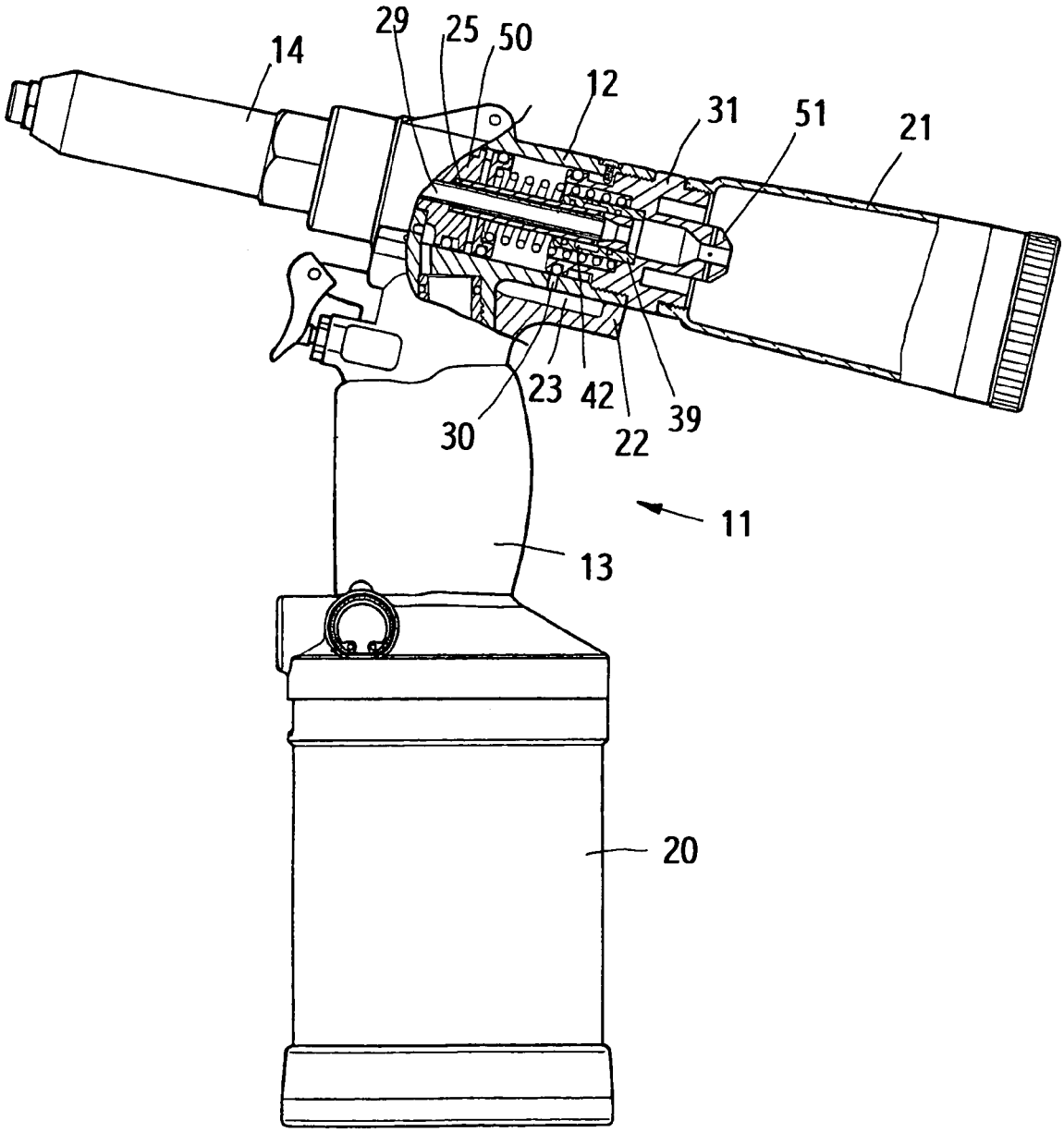
FIG. 4 is a sectional view of the present invention, showing the structure relation among parts of the rivet gun.
Figure 5:
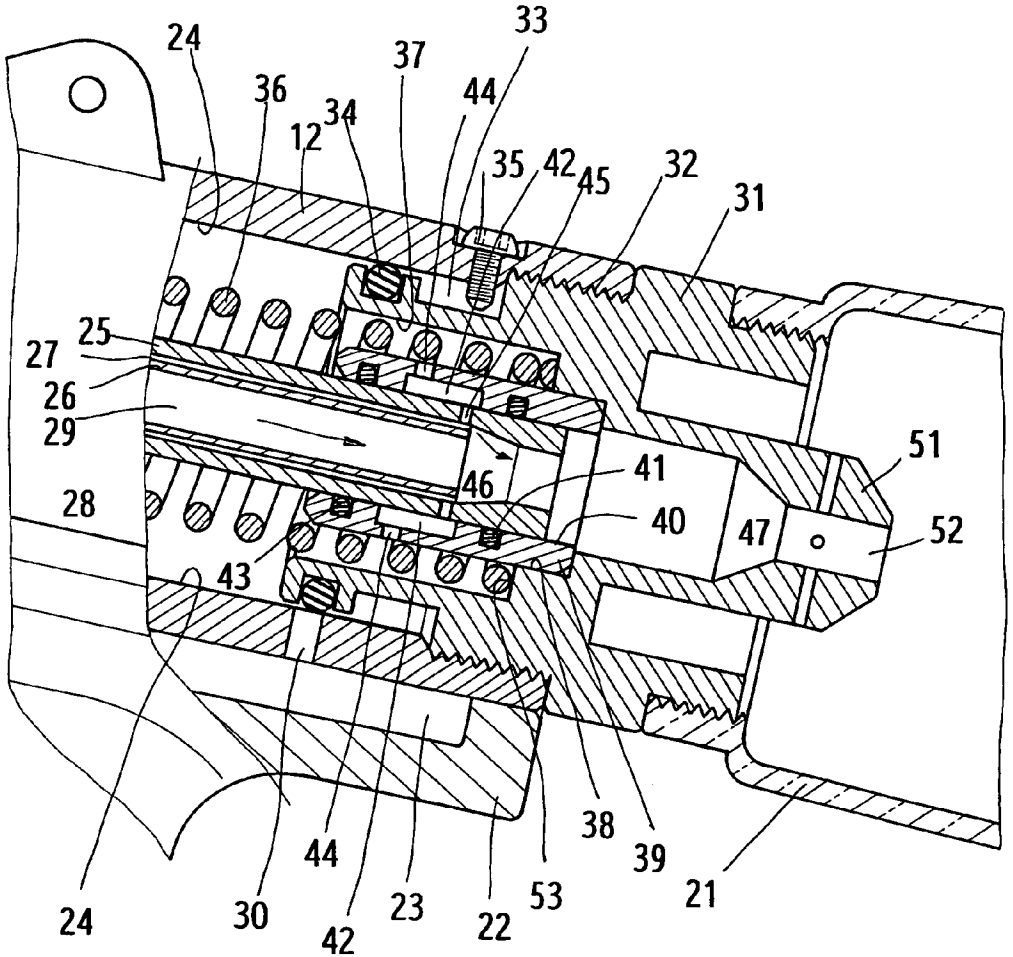
FIG. 5 is a sectional view of the present invention, showing the used rivet-repelling assembly of the rivet gun.

This invention relates to an automatic suction and repellent device for rivet gun; as shown in FIG. 1, the rivet gun 11 comprises a handle 13 with a pressure-air tank 20 under the handle, a trigger 19; a support frame 22, and a body 12 above the handle. The front end of the body 12 is furnished with a pull rod assembly 14, while the rear end thereof is furnished with a used-rivet cylinder 21. During rivet-pulling work, the used-nail cylinder 21 and the body 12 will be adjusted to a given space so as to ave an intake passage 23 in the support frame 22 and a center passage in the body 12 aligned into a backward repelling passage, and have a round hole on front end of the pull rod assembly 14 with a vacuum suction force. After the rivet pin 16 and the pull rod assembly 14 are assembled together, it will provide the functions of sucking, positioning and preventing from dropping so as to complete the rivet-pulling work. Then the used nail 28 can be sucked by means of vacuum suction force towards the used-nail cylinder 21 until being pulled into the used-nail cylinder 21.

As shown in FIGS. 2 to 5, an intake passage 23 is located above the handle 13. After the body 12 and the support frame 22 are assembled together, the intake passage 23 can only provide a vacuum suction force for repelling a used nail.

In the rivet gun 11, the piston-pulling rod 50 is driven to move by means of a hydraulic force so as to provide the pull rod assembly 14 with a rivet-pulling function. The center of the piston-pulling rod 50 has a through hole to facilitate a hollow long pipe 26 to connect with the pull rod assembly 14. The end thereof has a larger hole for mounting an outer sleeve pipe 25 therein; one end of the hollow long pipe 26 is mounted in the inner cylindrical hole of the outer sleeve pipe 25. There is a partition space 27 between the outer sleeve pipe 25 and the hollow long pipe 26 to facilitate a pressure air to enter through hub-shaped ventilation holes 45 and a convergent hole 46, and to exhaust air out. In that case, a vacuum suction force can be provided in the inner space of the hollow long pipe 26 to enable the pull rod 17 of various kinds of rivet pins 16 to be sucked in upon the pull rod 17 being plugged into the pull rod assembly 14. After the rivet-pulling work is done, the used rivet 28 will be repelled out.

The specification of rivet pins is different in size and weight, and therefore the vacuum suction force is also varied from rivet pin to rivet pin. In order to adjust the vacuum suction force for a specific rivet pin, an outer sleeve pipe 25 on the tail end of the body 12 and the hallow long pipe 26 are mounted on a regulation ring of a threaded hole 32 on the tail end of the body 12 so as to adjust the shifting position of an O-shaped ring and groove 34 in a regulation ring 31, i.e., to adjust the cross-sectional area between a small hole 30 and the intake passage 23 of the support frame 22 in the body 12.

The regulation ring 31 is used for adjusting the volume of the pressure air by means of a screwing method; the outer end thereof is furnished with threads to facilitate a used-nail cylinder 21 to mount, and the center of the outer end is furnished with a nail-repelling pipe 51 with a through cylindrical hole 52, of which the inner end is furnished with a rear guide hole 47; the inner end of the rear guide hole 47 has a cylindrical hole 38 with a larger diameter; the cylindrical hole 38 is mounted with a guide sleeve 39, of which the inner cylindrical surface 40 is in close contact with the outer sleeve pipe 25. As soon as a pressure air enters the ventilation hole 45 of the outer sleeve pipe 25, the pressure air will flow through a convergent hole 46 and will be exhausted through the nail-repelling pipe 51. The convergent hole 46 can provide the tail end of the hollow long pipe 26 with a venturi effect, i.e., to generate a suction force to have a rivet pin 16 sucked in automatically in place, and to repel a nail it out of the rivet-repelling pipe 51 after a rivet-pulling work done.

The regulation ring 31 screwed in the threaded hole 32 of the body 12 is furnished with a cylindrical hole 38 in the center thereof; the cylindrical hole 38 is connected with one end of a guide sleeve 39; the inner cylindrical surface 42 of the guide sleeve 39 is furnished with an elongate ring-shaped groove 42, of which both ends are furnished with two O-shaped rings and grooves 43 respectively. After the guide sleeve 39 is mounted to the outer surface of the outer sleeve pipe 25, the guide sleeve 39 and the outer sleeve pipe 25 can be moved relatively upon the regulation ring 31 being regulated; however, the elongate ring-shaped groove 42 of the guide sleeve 39 and the ventilation hole 45 of the outer sleeve pipe 25 would not change, i.e., always maintaining in communication state. The outer surface of the guide sleeve 39 is furnished with a ventilation hole 44 which is in communication with the inner cylindrical hole 24 of the body 12. After a pressure air flows into the inner cylindrical hole 24 of the body 12, the pressure air will enter the convergent hole 46 on the tail of the hollow long pipe 26.

The regulation ring 31 mounted on the threaded hole 32 of the body 12 is furnished with a limit ring 33 on the inner end thereof, and an O-shaped ring and groove 34 in close contact with the inner cylindrical hole 24; after the regulation ring 31 is mounted on the threaded hole 32, the O-shaped ring and groove 34 will be in close contact with the inner cylindrical hole 24. The regulation ring 31 can provide a screwing adjustment. In order to prevent the regulation ring 31 from being derailed, a limit screw 35 is mounted in the limit ring 33 of the regulation ring 31.

To provide a vacuum suction force for the rivet-pulling work, a through small hole 30 is furnished between the intake passage 23 of the support frame 22 and the inner cylindrical hole 24 of the body 12. As soon as the regulation ring 31 is screwed outwards, the small hole 30 will be moved out of the close contact state, a pressure air will enter the inner cylindrical hole 24 of the body 12, and flows through the ventilation hole 44 of the guide sleeve 39, the elongate ring-shaped groove 42, the ventilation hole 45 of the outer sleep pipe 25, and finally through the convergent hole 46 to exhaust. As soon as a rivet pin is plugged in, a vacuum suction force will be generated; during rivet-pulling work, the pressure air is controlled with a trigger 19 switch; after the pull rod 17 of a rivet pin 16 is broken with a pulling force, the rivet will become a used nail 28; then, the trigger 19 is released immediately to have the pressure air entered the convergent hole 46 of the outer sleeve pipe 25 so as to suck the used nail 28 to move backwards and to repel out at once.

One end of a spring 36 is mounted against the round surface 53 of the regulation ring 31 so as to provide the piston-pulling rod 50 with pushing force. When the regulation ring 31 is adjusted by screwing, the pushing force of the spring 36 would not be affected; the guide sleeve 39 in the spring 36 is fastened together with the regulation ring 31; and therefore when the regulation ring 31 is being adjusted, they will be moved together; in that case, the pressure air can enter the outer ventilation hole 44 and can flow through the elongate ring-shaped groove 42 and the ventilation hole 45 of the outer sleeve pipe 25; in other words, the pressure air would not be affected upon the regulation ring moving.

The outer end of the regulation ring 31 on the rear end of the body 12 is furnished with a rivet-repelling pipe 51; a guide sleeve 39 is mounted to the outer end of the outer sleeve pipe 25, of which the elongate ring-shaped groove 42 is in communication with the end space of the hollow long pipe 26; the ventilation hole 44 is in communication with the inner cylindrical hole 24 of the body 12. The pressure air is controlled with the trigger 19 of the handle 13; the pressure air can flow through the intake passage 23, the small hole 30 of the body 12 and into the inner cylindrical hole 24. The volume of pressure air to enter the inner cylindrical hole 24 through the small hole 30 is adjusted by means of screwing the regulation ring 31 so as to provide the hollow long pipe 26 with a vacuum suction force, and to enable the pull rod 17 of the rivet pin 16 to be sucked in and positioned in place upon the pull rod 17 of a rivet pin 16 plugged into the center hole of the pull connector 15 so as to prevent the rivet from dropping down. Upon a rivet-pulling work being done, the pull rod 17 becomes a used nail 28, which will be sucked and moved to the end of the round surface 29 of the hollow long pipe 26, and repelled into a used-nail cylinder 21 through the nail-repelling pipe 51 of the regulation ring 31.

While the invention has been described with reference to specific embodiments it must be understood that those embodiments are susceptible to many changes, substitutions, and modifications that will be readily apparent to those having ordinary skill in the art without departing from the scope and spirit of the invention.

What is claimed is:

1. An automatic suction and repelling device for a rivet pin in a rivet gun comprising:

a) a body mounted on a support frame connected to a handle of the rivet gun and having:

i) an inner cylindrical hole;

ii) an intake passage; and iii) at least one body hole communicating with the intake passage and the inner cylindrical hole;

b) a pull rod assembly located on a first end of the body;

c) a regulation ring having:

i) an O-shaped ring and a groove located adjacent to the at least one body hole;

ii) a center hole; and iii) a nail-repelling pipe;

d) a guide sleeve located in the center hole of the regulation ring and having an elongated ring-shaped groove and a first ventilation hole communicating with the elongated ring-shaped groove and the inner cylindrical hole of the body;

e) a used-nail cylinder, the regulation ring and the used-nail cylinder are located on a second end of the body, the nail-repelling pipe extending into an interior of the used-nail cylinder;

f) a piston-pulling rod inserted into the inner cylindrical hole of the body and having:

i) a hollow long pipe;

ii) an outer sleeve pipe inserted over the hollow long pipe and having a convergent hole located adjacent to an end of the hollow long pipe, the outer sleeve pipe having a second ventilation hole communicating with the elongated ring-shaped groove; and iii) a space located between the hollow long pipe and the outer sleeve pipe, wherein pressurized air selectively flows through intake passage, the at least one body hole, the inner cylindrical hole, the first ventilation hole, the elongated ring-shaped groove, the second ventilation hole, and the convergent hole creating a vacuum suction force pulling a pull rod of the rivet pin into the used-nail cylinder.

2. The automatic suction and repelling device according to claim 1, further comprising a pull connector connected to the pull rod assembly.

* * * * *